US005746629A

United States Patent [19]

Smith

[11] Patent Number: 5,746,629

[45] Date of Patent: May 5, 1998

[54] OUTBOARD MOTOR FLUSHING SYSTEM

[76] Inventor: Stanley K. Smith, 7780 Hayne Blvd., New Orleans, La. 70126

[21] Appl. No.: 722,963

[22] Filed: Sep. 30, 1996

[51] Int. Cl.[6] ..... B63H 21/10

[52] U.S. Cl. ..... 440/88; 134/167 R

[58] Field of Search ..... 440/88, 113, 900; 134/100, 167 R, 169 R

[56] References Cited

U.S. PATENT DOCUMENTS

| | | | |
|---|---|---|---|
| 3,320,964 | 5/1967 | Tripp | 134/100 |
| 4,121,948 | 10/1978 | Guhlin | 440/88 |
| 5,350,329 | 9/1994 | Haman | 440/88 |
| 5,397,256 | 3/1995 | Bidwell | 440/88 |
| 5,423,703 | 6/1995 | Lorenzen | 440/88 |
| 5,482,483 | 1/1996 | Rice | 440/88 |

*Primary Examiner*—Jesus D. Sotelo

*Attorney, Agent, or Firm*—Patent & Trademark Services; Joseph H. McGlynn

[57] ABSTRACT

An improved device for flushing and conditioning the cooling system of a marine outboard motor which has a reservoir, containing anti-corrosive fluid, and which communicates with a delivery system. The delivery system is a T-shaped member, having a lower pipe member communicating with an upper member that is threadedly connected to the reservoir. The lower pipe member is connected at either end to two lengths of garden hose, one of which is connected to a source of fresh water, and the other of which is attached to the flushing intake of an outboard motor. A valve disposed on the upper pipe member provides a means to selectively control the inflow of anti-corrosive material from the reservoir into the delivery system.

1 Claim, 1 Drawing Sheet

FIG. 1
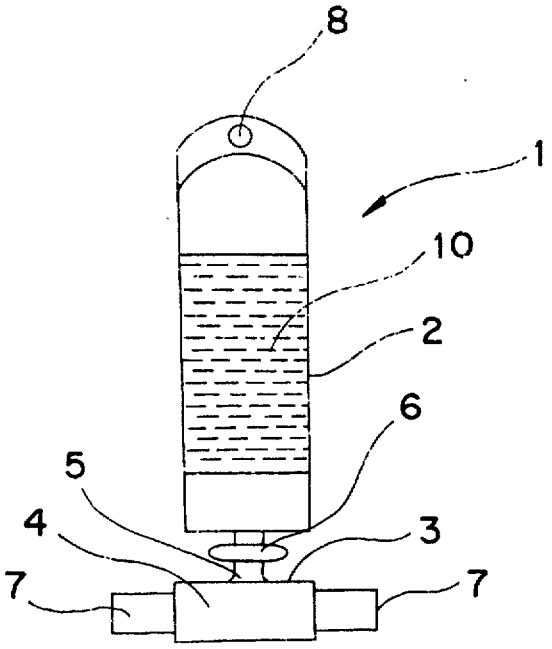
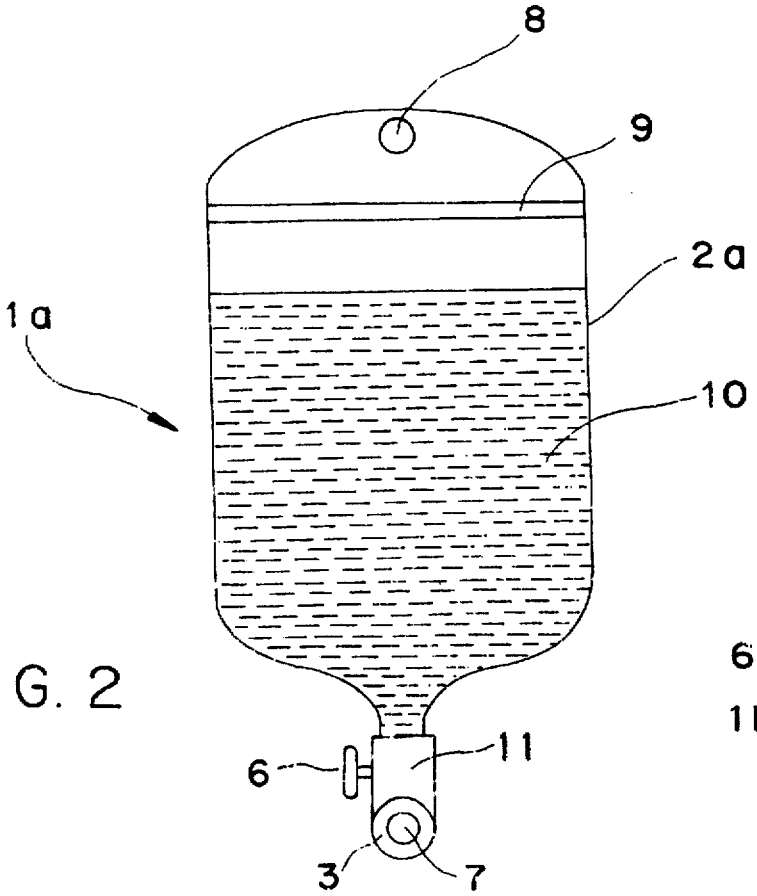
FIG. 2
FIG. 3
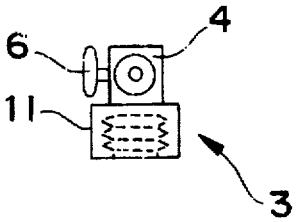

OUTBOARD MOTOR FLUSHING SYSTEM

BACKGROUND OF THE INVENTION

The present invention relates generally to outboard marine motors, and in particular to an improved device for flushing outboard cooling systems and for providing the same with anti-corrosive conditioning elements.

DESCRIPTION OF THE PRIOR ART

Outboard marine motors are generally provided with a cooling system which draws ambient water into a jacket surrounding the engine. To prolong the life of such engines, it is necessary to flush the cooling system periodically to remove mineral deposits and other contaminants. Various devices for flushing outboard marine motors are known. However, as described below, these inventions suffer from several drawbacks which make it desirable to have known an improved, anti-corrosive flushing system.

For example, U.S. Pat. No. 5,350,329 discloses a flushing assembly having a valve member disposed thereon for selectively controlling the inflow of flushing fluid to a an outboard cooling jacket.

U.S. Pat. No. 5,379,256 describes an apparatus for flushing a marine motor, employing hydraulically operated clamping members which engage opposite sides of an engine housing and a check valve to control water inflow. While providing a means to deliver water from a hose to the cooling jacket, these inventions do not provide a means to introduce a known quantity of anti-corrosive compound.

U.S. Pat. No. 5,423,703 describes an outboard motor flushing apparatus having a U-shaped sealing element retainer for covering the inlets to a cooling system and a rigid pipe with couplings for communicating water to the sealing elements. This invention is a complex device, having a number of attachments which render it inconvenient and undesirable. This invention, as well, lacks a means to deliver anti-corrosive compounds to the outboard cooling system.

U.S. Pat. No. 5,482,483 describes a flushing device comprising a reservoir for water storage and a delivery system to a marine engine. This device is bulky and inconvenient, having a large reservoir which must be set above the engine to allow for the operation of gravity to propel the flushing fluid.

There remains a need in the art for an outboard engine flushing device which is portable, convenient, and inexpensive. Moreover, there remains a need in the art for a flushing system which provides a means to deliver a quantity of anti-corrosive compound to the engine during the flushing process. The addition of such a compound to the cooling system is desirable for the purpose of preventing corrosion and prolonging engine life. The present invention, described in detail below, provides a system for flushing an outboard motor and delivering anti-corrosive compound to the engine. The invention overcomes the drawbacks of the prior art flushing systems and provides additional advantages not afforded by the inventions heretofore disclosed.

SUMMARY OF THE INVENTION

The present invention is a flushing and conditioning system which can be used on all types of outboard marine motors to clean outboard cooling systems and prolong engine life. The invention comprises a reservoir and a delivery system. The reservoir may consist of a rigid container, or it may be constructed as a flexible bag with a sealable top opening. The reservoir is provided with a hole at its top edge, providing a means for tied attachment to the side of an engine. The reservoir contains a quantity of anti-corrosive liquid which may be selectively delivered to the cooling system during the flushing process through the operation of the delivery system.

The delivery system is mounted on the bottom of the reservoir and is designed to provide communication of water and of the anti-corrosive material into the cooling system. The delivery system consists of a rigid, T-shaped member having threaded ends for connection to a pair of garden hose lengths. The distal end of one garden hose length is connected to the intake port of a flushing system. The other garden hose is attached to a spigot which provides a flushing stream. The upper portion of the delivery system communicates with the reservoir and is provided with a valve controlling the flow of the anti-corrosive fluid into the hose. The valve controlling the flow is initially closed, allowing the engine to be flushed first by pure water. After the engine has been flushed, the valve is opened to permit the flow of anti-corrosive fluid into the engine.

Accordingly, it is an object of the present invention to provide an improved flushing system for a marine outboard motor cooling system.

It is also an object of this invention to provide an outboard motor flushing system which is inexpensive, convenient, and portable.

It is still further an object of this invention to provide an outboard motor flushing system which can be used to selectively deliver a quantity of anti-corrosive fluid to the cooling system of an outboard motor.

These and other objects and advantages of the present invention will become apparent from the detailed description below, when taken in conjunction with the annexed drawings.

BRIEF DESCRIPTION OF THE DRAWINGS

FIG. 1 shows a front elevational view of an embodiment of the present invention having a rigid reservoir container.

FIG. 2 shows a side elevational view of of an embodiment of the present invention having a flexible reservoir.

FIG. 3 shows a sectional view of the delivery system of the present invention.

DESCRIPTION OF THE PREFERRED EMBODIMENT

Referring now to the drawings in greater detail, an embodiment of the present invention 1 may be seen in FIG. 1 comprising a reservoir 2 and a delivery system 3. In the embodiment shown in FIG. 1, the reservoir 2 consists of a rigid container, preferably constructed from durable plastic or some similar, non-corrosive, lightweight material. The reservoir 2 preferably has a hole 8 formed near the top margin thereof, providing a means to tie the reservoir 2 to the side of a boat or outboard engine. The bottom of the reservoir 2 has a threaded opening (not shown) for receiving the upper end 5 of the delivery system 3, described below.

In use, the reservoir 2 is filled with an anti-corrosive fluid 10, which may consist of a solution of baking soda and water. However, there exist a number of commercially available anti-corrosive compounds, and a variety of these solutions may be used without departing from the scope of the invention.

An alternative embodiment 1*a* of the present invention is depicted in FIG. 2, having a flexible reservoir 2*a* with an interlocking, channeled closure means 9, similar to the closure means used on zip-lock type plastic bags, disposed near the top margin of the reservoir 2a. In this embodiment 1a, the reservoir 2a could consist of a pleated bag of heavy, flexible, plastic construction. The reservoir 2a preferably would be heat welded or otherwise securely connected to a rigid lower portion 11 having an interior threaded portion for attachment to the delivery system 3. The embodiment 1a depicted in FIG. 2 would be preferable to some users because the reservoir 2a could be folded or rolled up for easier storage and transportation.

The delivery system 3 is disposed below the reservoir 2 and provides a channel for the communication of water and anti-corrosive fluid 10 to the cooling system of an outboard engine. As shown in FIG. 1 and sectionally in FIG. 3, the delivery system 3 is a generally T-shaped arrangement, having a lower pipe member 4 communicating normally with an upper pipe member 5. Pipe members 4, 5 have female threaded end portions 7, with the upper pipe 5 being threadedly connected to the reservoir 2 and the lower pipe 4 having female threads to threadedly connect to the ends of a garden hose. A valve 6 is disposed on the upper pipe member 5, providing a means to selectively control the flow of anti-corrosive fluid 10 from the reservoir 2 into the delivery system 3. The delivery system 3 may be constructed from hard plastic or any other durable, non-corrosive material.

To use the invention 1, the reservoir 2, 2a is filled with the desired anti-corrosive solution 10 and, with the valve 6 in the closed position, the reservoir 2, 2a is threadedly connected to the upper pipe member 5 of the delivery system 3. The lower pipe member 7 is then threadedly connected at either end to two lengths of garden hose, one hose being attached to a source of fresh water, and the other being attached to the flushing intake of the outboard motor. The spigot is then activated, flushing the motor's cooling system. After the motor has been appropriately flushed, the valve 6 is turned to allow the anti-corrosive fluid 10 to enter the cooling system.

The present invention 1 is inexpensive, lightweight, and portable, providing a convenient means to flush and condition the cooling systems of all types of marine outboard motors.

Although the outboard motor flushing system and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A system for flushing an outboard motor, said system comprising:

container means for holding a outboard motor flushing compound, said container means comprising a top, a bottom and at least two sides, means for securing said container means to a support, aperture means for allowing said outboard motor flushing compound to exit from said container means, T-shaped means having one arm connected to said aperture means, a second arm of said T-shaped means having female threads for connecting to a hose, and a third arm of said T-shaped means having female threads for connected to a second hose, valve means connected between said aperture means and said T-shaped means for controlling the flow of said outboard motor flushing compound, and wherein said container means is made from a flexible material, and wherein said container means has a resealable closure means, at an end opposite said T-shaped means, for allowing said container means to be filled with an outboard motor flushing compound, said releasable closure means comprising an opening extending between said at least two sides, one of said sides having a channel extending approximately across all of said one of said sides, and another of said sides having a tongue extending approximately across all of said another of said sides, said tongue being sealing engaged within said channel in order to close said opening, and said tongue being removed from said channel in order to open said opening.

* * * * *